US007244092B1

(12) United States Patent
Darst

(10) Patent No.: US 7,244,092 B1
(45) Date of Patent: Jul. 17, 2007

(54) CAR LIFTING PLATFORM

(75) Inventor: Robert Darst, Louisville, KY (US)

(73) Assignee: Republic Industries International, Inc., Louisville, KY (US)

( * ) Notice: Subject to any disclaimer, the term of this patent is extended or adjusted under 35 U.S.C. 154(b) by 123 days.

(21) Appl. No.: 11/123,308

(22) Filed: May 6, 2005

(51) Int. Cl.
*B66C 3/00* (2006.01)

(52) U.S. Cl. ..... 414/785; 414/607

(58) Field of Classification Search ..... 414/603, 414/611, 619, 607; 187/237; 404/785
See application file for complete search history.

(56) References Cited

U.S. PATENT DOCUMENTS 2,675,139 A * 4/1954 Mercier et al. ..... 414/607
3,312,361 A * 4/1967 Foster ..... 414/724
3,387,731 A * 6/1968 Gibson et al. ..... 414/639
4,239,446 A * 12/1980 Vucinic ..... 414/785
4,355,947 A * 10/1982 Wiblin ..... 414/785
4,619,579 A * 10/1986 Frison ..... 414/607
4,790,717 A * 12/1988 Anderson ..... 414/722
5,064,338 A * 11/1991 Lawrence ..... 414/685
5,564,885 A * 10/1996 Staben, Jr. ..... 414/724
6,425,212 B1 * 7/2002 Lovazzano ..... 52/105

* cited by examiner

*Primary Examiner*—Gene O. Crawford
*Assistant Examiner*—Gina M. Lupino
(74) *Attorney, Agent, or Firm*—Camoriano and Associates; Theresa Fritz Camoriano; Guillermo Camoriano

(57) ABSTRACT

A car lifting platform including a plurality of "L" shaped forks in a parallel mounting arrangement with plates interconnecting the forks. The plates are secured (typically by welding) to the forks and extend substantially along the horizontal leg of the "L", around the ell portion of the "L and at least part way up the vertical leg of the "L". The ell portion of the plate may include oval-shaped through openings to allow foreign objects to fall off of the platform and to receive a projection from the object to be carried on the platform in order to limit sliding motion of the object carried on the platform.

3 Claims, 5 Drawing Sheets

CAR LIFTING PLATFORM

BACKGROUND OF THE INVENTION

The present invention relates to a car lifting platform. More particularly, it relates to a car lifting platform wherein the platform mounts to a mast which in turn allows the mounting of the lifting platform to a motorized, heavy-duty piece of equipment, such as a wheel loader.

In certain applications, heavy duty equipment, such as wheel loaders, are used to move and place heavy pieces of machinery. Typically, this heavy machinery is picked up using a fork lift type of attachment. These forks are mounted to a mast which in turn mounts onto the wheel loader.

Specifically in highwall mining operations, conveyor cars (or auger transporting cars) are picked up from a storage area using car lifting platforms and are transported to a launch vehicle where the cars are hooked up to a continuous miner which engages and advances these cars as it mines an ore seam. These cars are typically 40 feet long and quite heavy.

Prior art car lifting platforms used in the highwall mining industry are fabricated from fork-lift forks with flat plates welded in between each fork in order to form a high strength, continuous platform. The fork-lift forks are "L" shaped elements, with one leg of the "L" being shorter and extending in the substantially vertical direction (and referred to as the riser) and the other leg of the "L" being longer and extending in the substantially horizontal direction to form the platform itself.

In prior art car lifting platforms, the flat plates welded between each fork extend only along the horizontal legs of the "L", stopping just short of the 90 degree angle (hereinafter called the "ell" of the fork) which connects the platform to the risers. This allows dirt or other foreign objects to fall through the forks in order to keep the platform clean. It also permits a locating tab or pawl, projecting from the car or other object being lifted, to engage the opening between two of the forks in order to limit the amount of slipping (along the longitudinal axis of the car) allowed of the car during transportation.

In the prior art design, the ells are the point of stress concentration of these car lifting platforms. Fatigue cracks develop at these stress points, and, in short order, the fatigue cracks propagate and the forks break.

SUMMARY

The present design provides a lift platform with longer life than the prior art design, even using the same thickness or gauge of materials. In this design, the plates which extend along the horizontal legs of the "L" shaped forks are bent to conform to the "ell" shape of the fork and extend at least part of the way up the riser portion of the fork. These plates are welded between the forks.

In a preferred embodiment, through openings are located at the "ells" of the plates to allow for debris removal and to provide a locking window to accommodate a projection from the car or other object being lifted (to prevent the car from sliding on the lifting platform, along the longitudinal axis of the car). These openings are preferably oval-shaped to eliminate stress risers which could more readily initiate fatigue cracks.

Despite these through openings, the bent plates, welded not only along the horizontal platform portion but also along the riser portion and the ell portion of the forks, reduce the magnitude of the stresses. In a preferred embodiment, the stresses are more evenly distributed, and they are reduced approximately in half from the prior art design. Some of the stress is transferred up to the riser portion of the car lifting platform. Based on this reduction and redistribution of the stresses, the life of the car lifting platform made in accordance with the present invention is substantially longer than that of prior art car lifting platforms.

DESCRIPTION OF THE PREFERRED EMBODIMENT

Figure 1:
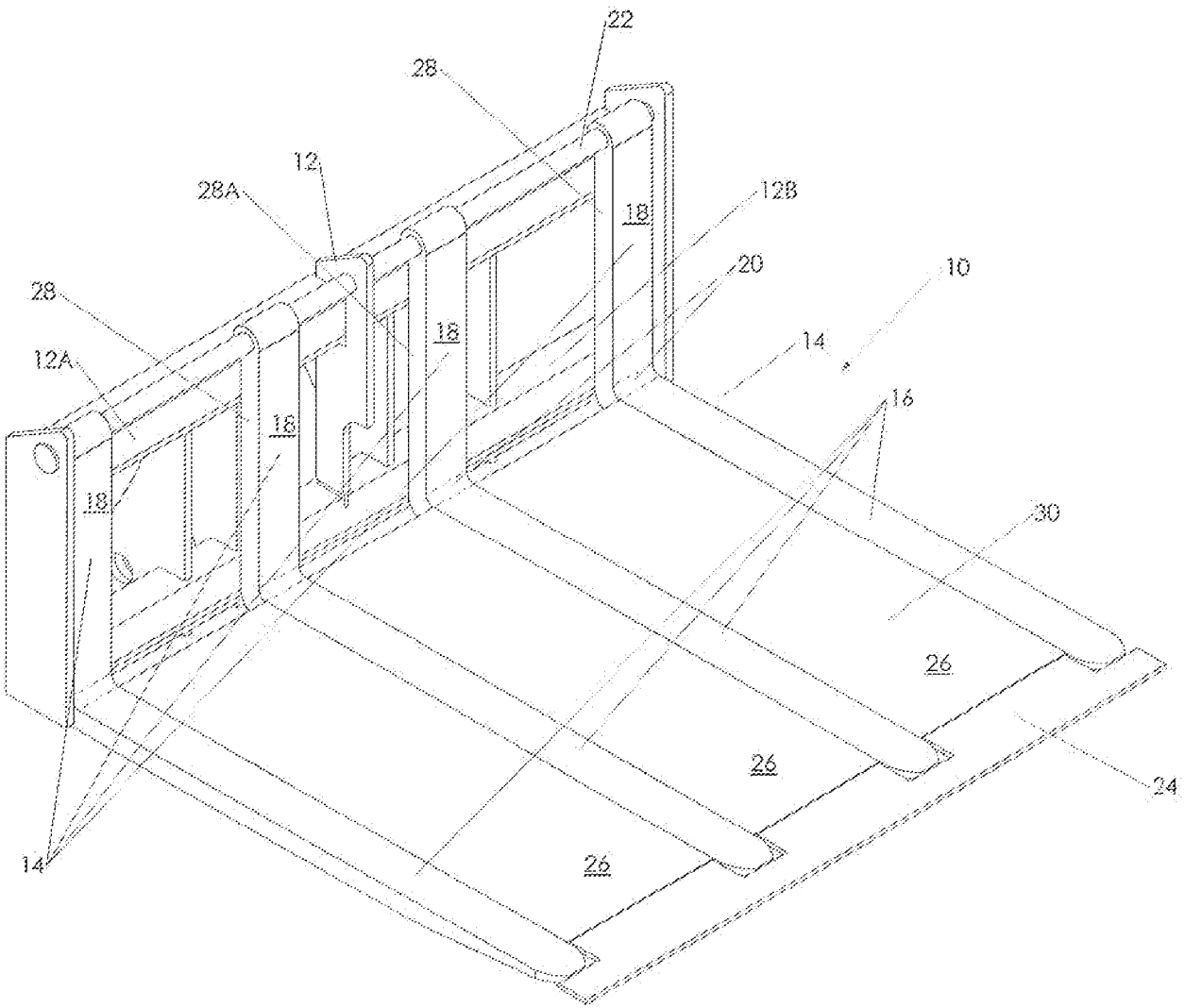
Fig 1 Prior Art
FIG. 1 is a perspective view of a car lifting platform and mast of the prior art.
Figure 2:
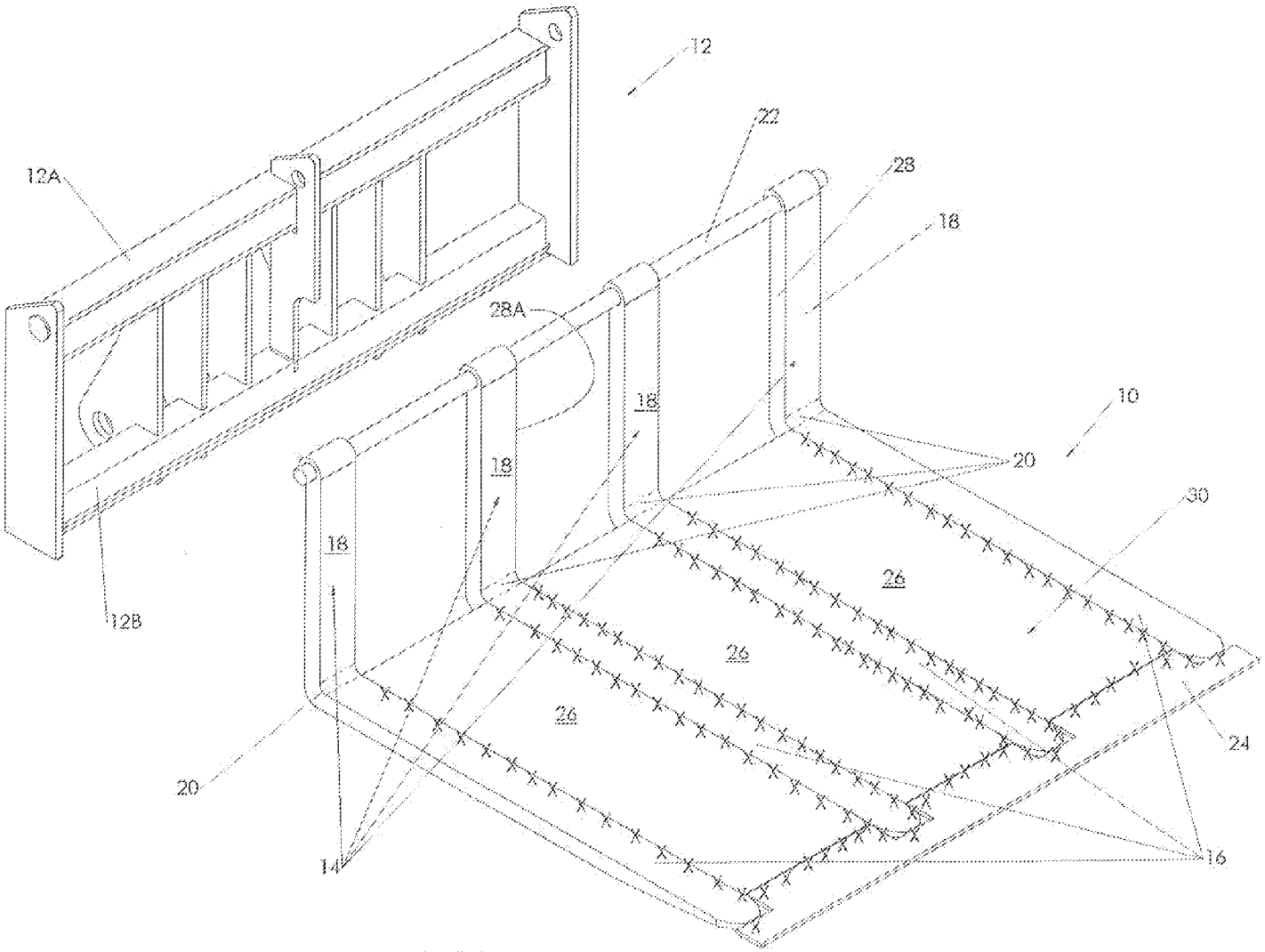
Fig 2 Prior Art
FIG. 2 is an exploded, perspective view of the car lifting platform and mast of FIG. 1 (prior art)
Figure 3:
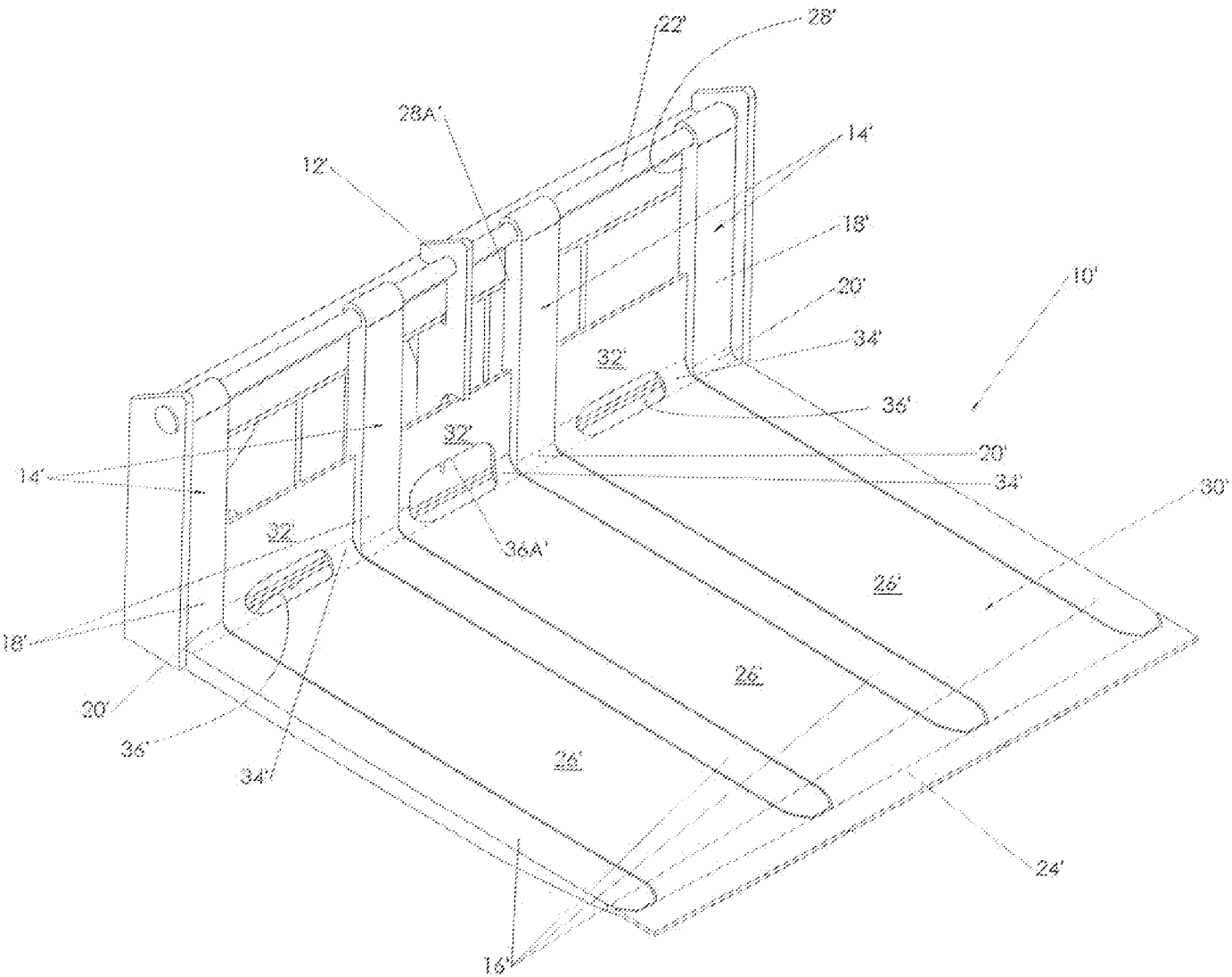
FIG. 3 is a perspective front view of a car lifting platform and mast made in accordance with the present invention.
Figure 4:
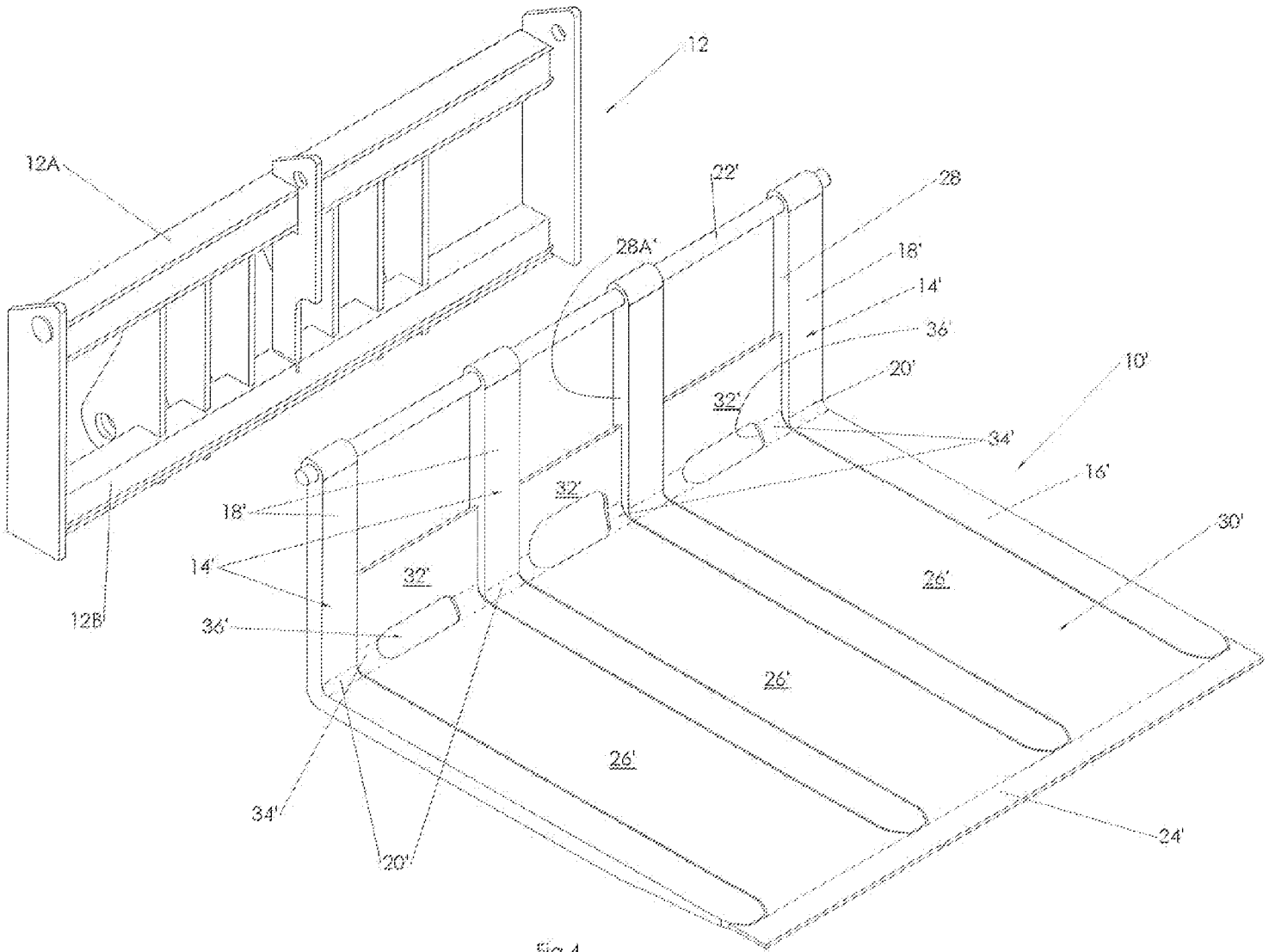
FIG. 4 is an exploded, perspective view of the car lifting platform and mast of FIG. 3.
Figure 5:
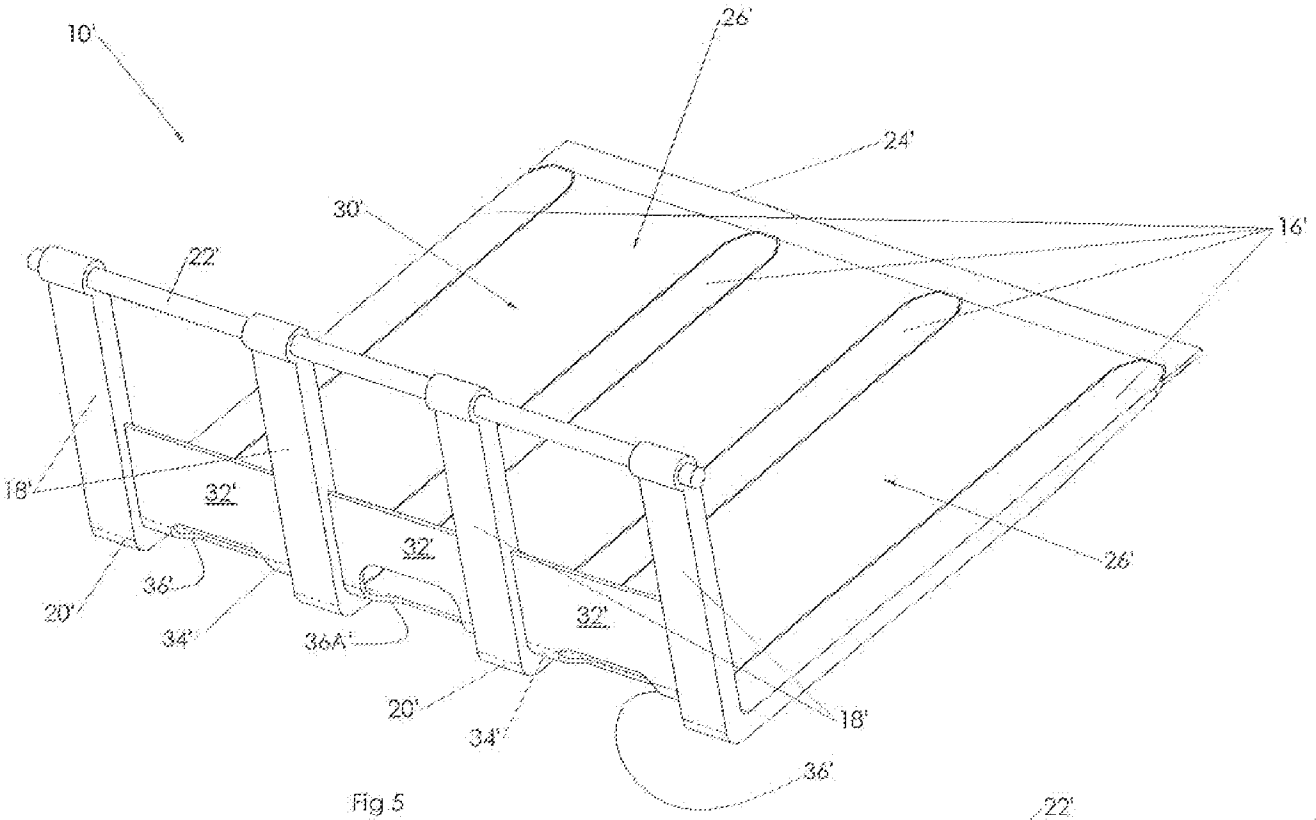
FIG. 5 is a rear perspective view of the car lifting platform of FIG. 3.
Figure 6:
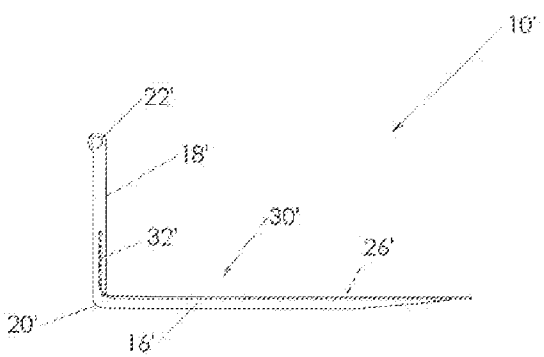
FIG. 6 is an end view of the car lifting platform of FIG. 5.

FIGS. 1 and 2 show a prior art car lifting platform 10 and a mast 12 for adapting the platform 10 to be mounted on a wheel loader (not shown). The car lifting platform 10 includes a plurality of fork-lift forks 14, which are interconnected in a parallel mounting arrangement as shown.

Each fork 14 defines a substantially horizontal fork platform portion 16, a substantially vertical fork riser portion 18, and a fork "ell" portion 20 which is a curved portion that interconnects the platform portion 16 to the riser portion 18 of each fork 14 roughly at right angles. The forks 14 are interconnected by a mounting bar 22, which extends through openings in the ends of the riser portions 18, and by a wear plate 24, which connects together the free ends of the platform portions 16.

In addition, substantially flat plates 26 are inserted into the gaps between the forks 14, substantially filling the gaps between the platform portions 16 of adjacent forks 14. The plates 26 are secured, typically by welding, to the respective platform portions 16 of adjacent forks 14, as shown best in FIG. 2. Each plate 26 extends substantially the length of the platform portions 16, from the wear plate 24 to the ell portion 20 of the forks 14, to define a plate platform portion 30.

Other than the mounting bar 22 (which not so much connects as extends through the ends of the risers 18), there are no plates or other mechanisms bridging the gaps 28 between the riser portions 18 or between the ell portions 20 of the forks 14. These gaps 28 are left open so that any debris (such as gravel or dirt, for instance) may readily fall off of the platform portion 30 of the lifting platform 10. Typically, one of the gaps 28A between two adjacent riser portions 18 serves as a window which engages a pawl or other projection (not shown) on a car being lifted so as to limit the amount of sliding of the car when the car is on the platform 30.

The mast 12 is a standard mast, as is well known in the industry, adapted for mounting the car lifting platform 10 to a wheel loader (not shown). The car lifting platform 10 mounts to the mast 12 by means of the mounting bar 22, which extends through openings in the mast 12 and through openings in the car lifting platform 10. The vertical legs 18 of the car lifting platform 10 rest against upper and lower horizontal bars 12A, 12B of the mast 12.

FIGS. 3-6 depict an example of a car lifting platform 10' made in accordance with the present invention. This car lifting platform 10' is very similar to the car lifting platform 10 described earlier, with the main difference being that the plates 26' are bent and extend up into the space between the riser portions 18' of the forks 14'. Please note that corresponding items in the two embodiments 10, 10' are similarly labeled with the same item or reference numbers, but followed by a "superscript prime" (') to designate this second embodiment 10'. Examples of this are the mast 12', the gaps 28' and 28A', and the openings 36A'.

Each fork 14' defines a substantially horizontal fork platform portion 16', a substantially vertical fork riser portion 18', and a fork "ell" portion 20' which connects the platform portion 16' to the riser portion 18' at approximately right angles. The forks 14' are interconnected by a mounting bar 22', which extends through openings in the ends of the riser portions 18', and by a wear plate 24', which connects together the free ends of the platform portions 16'.

The plates 26' are inserted into the gaps between the forks 14' and are connected to the forks 14'. Unlike the prior art design, the plates 26' are not substantially flat plates. Instead, the plates 26' are bent so as to conform to the ell portion 20' of the forks 14' and extend approximately half-way up the risers 18' of the forks 14'. Each plate 26' substantially fills the gap between the platform portions 16', the ell portions 20' and the riser portions 18' of its two respective forks 14' and is secured, typically by welding, to the platform portions 16', the ell portions 20', and the riser portions 18', respectively, of the adjacent forks 14'.

The platform portions 16' of the forks 14' and the horizontal portions of the plates 26' together form the platform portion 30' of the car lifting platform 10'. The substantially vertical portions 32' of the plates 26' are welded to the riser portions 18' of the forks 14', and together they form the riser portion of the car lifting platform 10'. This riser portion 32' of each plate 26' extends at least partially along the height of the riser portion 18' of the forks 14' (and in a preferred embodiment it extends approximately half way up the riser portion 18') and is welded to the riser portion 18' of the forks 14'.

Finally, each plate 26' includes an ell portion 34', which extends along and is welded to the ell portions 20' of the adjacent forks 14'. The ell portions 34' of the plates 26' define through openings 36' which are oval shaped and are elongated a greater distance in the side-to-side horizontal direction than in the vertical direction. These openings 36 allow any foreign objects (such as gravel or dirt) to fall off of the platform 30' in order to keep the platform relatively clean. The oval shape of the openings 36' reduces the opportunity for stress risers, thereby greatly reducing the initiation of stress cracks which could lead to premature fatigue failure of the platform 10'. Typically, one of the through openings 36A' serves as a window which engages a pawl or projection (not shown) on a car being lifted so as to limit the amount of sliding of the car when on the platform 30'.

The extended length of each plate 26', which not only extends along the platform portions 16' of the forks 14', but also bends to follow the bend of the ell portion 20', and extends at least part way up the riser portion 18', lends additional rigidity and strength to the platform 10'. The amount of stress experienced by the platform 10' is reduced, and the location and distribution of these reduced stresses are changed, resulting in an improved design with an extended fatigue life over that of the prior art.

As was the case for the previously described prior art platform 10, the mast 12 is a standard mast, as is well known in the industry, adapted for mounting the car lifting platform 10' to a wheel loader (not shown).

It will be obvious to those skilled in the art that modifications may be made to the embodiment described above without departing from the scope of the present invention.

What is claimed is:

1. A car lifting platform, comprising:

a plurality of "L" shaped fork-lift forks, each fork defining a substantially horizontal fork platform portion, a substantially vertical fork riser portion, and a fork ell portion connecting said fork platform portion to said fork riser portion; wherein said forks are interconnected to each other in a substantially parallel arrangement, which defines gaps between the respective platform, riser and ell portions of adjacent forks; and a plurality of substantially "L" shaped interconnecting plates, each of said interconnecting plates defining a substantially horizontal plate platform portion, a substantially vertical plate riser portion, and a plate ell portion connecting said plate platform portion to said plate riser portion; each of said interconnecting plates lying within and substantially filling the gap between two adjacent forks, with the plate riser portion, plate ell portion, and plate platform portion being secured to the respective fork riser portions, the fork ell portions, and the fork platform portions of those two adjacent forks.

2. A car lifting platform as recited in claim 1, wherein said plate ell portions define substantially oval-shaped, through openings.

3. A car lifting platform as recited in claim 1, and further comprising a mast for adapting the car lifting platform for mounting to a wheel loader, and a mounting bar extending through said vertical riser portions of said forks and through said mast.

* * * * *